US008215254B2

(12) United States Patent
Pavlow et al.

(10) Patent No.: US 8,215,254 B2
(45) Date of Patent: Jul. 10, 2012

(54) COVERS AND LINERS FOR SEA CHESTS

(75) Inventors: Bruce Pavlow, New Gloucester, ME (US); Allen Estes, Standish, ME (US)

(73) Assignee: Advanced Marine Technologies, LLC, Portland, ME (US)

( * ) Notice: Subject to any disclaimer, the term of this patent is extended or adjusted under 35 U.S.C. 154(b) by 0 days.

(21) Appl. No.: 12/277,018

(22) Filed: Nov. 24, 2008

(65) Prior Publication Data

US 2010/0126402 A1 May 27, 2010

(51) Int. Cl.
*B63B 39/03* (2006.01)

(52) U.S. Cl. ..... 114/125

(58) Field of Classification Search ..... 114/67 A, 114/125; 440/46
See application file for complete search history.

(56) References Cited

U.S. PATENT DOCUMENTS 2,143,662 A * 1/1939 Schwarz ..... 217/3 FC
4,996,261 A 2/1991 Lebovits et al.
5,540,605 A * 7/1996 Lin ..... 440/46
5,692,451 A 12/1997 Pastore
6,402,163 B1 * 6/2002 Pratt ..... 280/11.26
6,904,858 B2 * 6/2005 Pastore ..... 114/125
2005/0136221 A1 * 6/2005 Fabick, Jr. ..... 428/156
2007/0187066 A1 8/2007 Leeson et al.

OTHER PUBLICATIONS

Webster's New Riverside University Dictionary, 1984, Houghton Mifflin Company, Boston, MA, definition of "coating" p. 275.*

* cited by examiner

*Primary Examiner* — Stephen Avila

(57) ABSTRACT

In a sea chest defining a hull opening and an interior, a sea chest cover for covering the hull opening and allowing water to flow in and out of the sea chest interior is combined with a sea chest liner for lining the sea chest interior, wherein the sea chest cover and the sea chest liner are made of a non-metallic material. In one aspect of the invention, the sea chest cover has one or more apertures formed therein for allowing water to flow in and out of the sea chest interior, and the one or more apertures are configured to prevent or reduce cavitations. In another aspect of the invention, the sea chest liner is a coating of a non-metallic material applied to the sea chest interior. In yet another aspect of the invention, the sea chest liner being designed to have adjustable lateral dimensions.

12 Claims, 4 Drawing Sheets

COVERS AND LINERS FOR SEA CHESTS

BACKGROUND OF THE INVENTION

This invention relates generally to sea chests and more particularly to covers and liners used with sea chests.

In many water-going vessels, particularly ocean-going vessels, the hull is provided with superstructure compartments that receive and expel water. These compartments are known generally as "sea chests" and usually take form of cavities of various shapes. Sea chests are sealed with respect to the interior of the vessel and are frequently an integral part of the hull. One example of a function of a sea chest would be to house valves designed to regulate the flow of water into and out of the vessel for use as ballast and/or engine cooling. Another example is housing maneuvering thrusters that cause water to be forced from the compartment. Yet another example would be housing sensors used to determine the speed of the vessel or the depth of the water below the vessel. If such valves, thrusters, or sensors, which must be in contact with the water in order to operate correctly, were placed directly on the exterior of the vessel's hull, they would be subject to catastrophic stresses from the water flowing by, from debris, or from any substantive structure that the hull might contact. Accordingly, it is common to place such water-contacting equipment within a sea chest, which can be filled with water but provides a compartment that is essentially protected by the vessel's hull.

To prevent debris or floating material of any kind from entering a sea chest, a cover shaped to the contour of the ship's hull at the location of the sea chest, is mounted over the chest opening. These covers generally comprise a grate or a plurality of holes that permit water to enter or exit the sea chest, dependent upon the pressure differential between the sea chest interior and the hull exterior. The cover thus acts as a filter to keep debris out of the sea chest while allowing free passage of water therethrough.

Sea chest covers are frequently made of cast iron or steel to provide sufficient structural strength. When the equipment within a sea chest must be repaired or otherwise worked on, the sea chest cover must first be removed. This is either done in dry dock or as part of an underwater operation. However, because sea chest covers are typically heavy, awkward pieces of metal, removal and replacement of such covers can be a very difficult task—particularly when carried out underwater.

Another major difficulty with traditional sea chests is "biofouling," that is, the growth of algae, barnacles, or other marine organisms on the interior of the sea chest as well as the cover. At a microscopic level, the relatively rough metal surfaces make for excellent attachment sites for such organisms. Cleaning the cover and the interior of the sea chest is a difficult task. Furthermore, such fouling diminishes flow of water into and out of the sea chest, and can even clog the sea chest and jeopardize the onboard operations that utilize the water. In cold waters, ice crystals can also grow on sea chest covers and clog the sea chests. Heating techniques to remove ice build up tend to be prohibitively expensive.

Another difficulty arises from the fact that metal surfaces of water-going vessels are susceptible to corrosion. Corrosion is particularly of concern with ocean-going vessels because the high concentration of salt in seawater accelerates corrosion. This is especially the case with sea chest covers formed from cast iron, as the covers suffer from deposits of salts and associated pitting due to electrolytic reactions stemming from the dissimilar metals of the hull and the covers in a bath of essentially dissociated ionic salts. Generally, corrosion is combated by protecting all water-contacting surfaces—including all surfaces of the sea chest and the cover—with some form of sealant. For the most part, that sealant is paint. Under the conditions typically experienced, vessel hulls must be painted frequently because any breaks in the thin protective coat of paint become a starting point for corrosion. This remedy is at best moderately successful and is very expensive because the procedure requires the vessel to be in dry dock.

Another problem associated with metal components in water is that of erosion caused by the flow of water and foreign particles contained in the water. The erosion caused by scouring effect of a vessel's movement in the water flakes off paint and pits the metal surfaces of the sea chest covers. Over time, the cover may be eroded enough to require replacement. Furthermore, pitting from erosion and corrosion enhances the growth of marine organisms by supplying a foothold or anchor to the metal surfaces.

Yet another concern related to the use of metal sea chest covers is noise and vibration. When a vessel moves through the water, turbulent flow rates impart vibrational energy to the vessel's hull, including the metal sea chest covers. Such vibrations will generate noise and can cause operational difficulties. Water flowing through the cover will also generate noise. These noises all contribute to the acoustic signature of the vessel. The lack of energy-absorbing capability is a particular problem where it is desirable to avoid the transmittal of sound waves to the surrounding water.

SUMMARY OF THE INVENTION

One embodiment of the present invention includes, in a sea chest defining a hull opening and an interior, the combination of a sea chest cover for covering the hull opening and allowing water to flow in and out of the sea chest interior and a sea chest liner for lining the sea chest interior, wherein the sea chest cover and the sea chest liner are made of a non-metallic material. In one aspect of the invention, the sea chest cover has one or more apertures formed therein for allowing water to flow in and out of the sea chest interior, and the one or more apertures are configured to prevent or reduce cavitations. In another aspect of the invention, the sea chest liner is a coating of a non-metallic material applied to the sea chest interior. In yet another aspect of the invention, the sea chest liner being designed to have adjustable lateral dimensions.

DETAILED DESCRIPTION OF THE INVENTION

Figure 1:
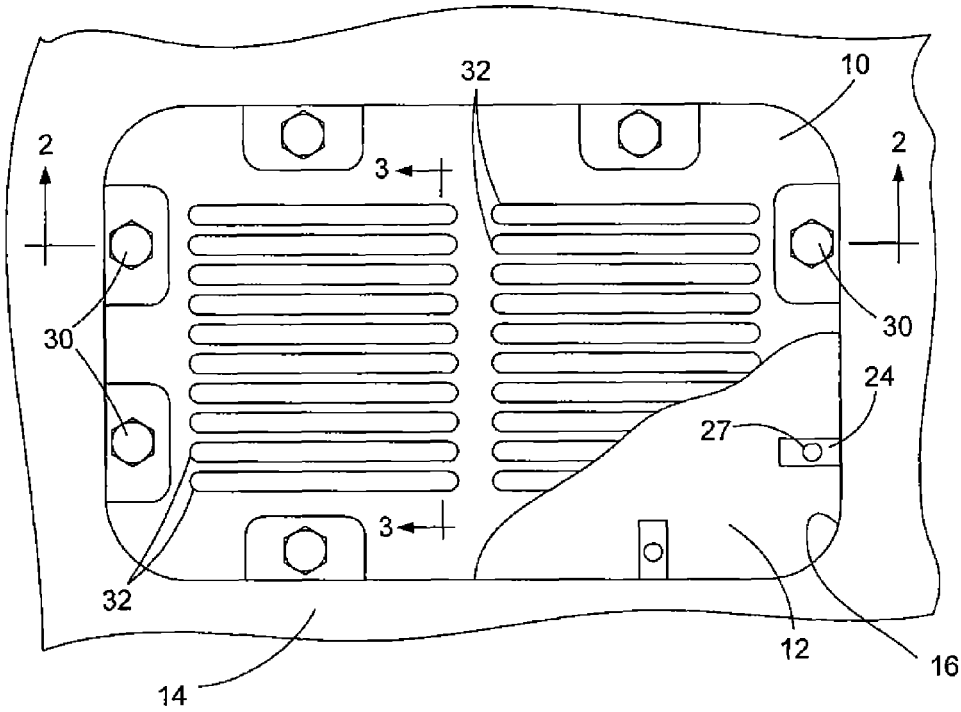
FIG. 1 is a plan view of a sea chest in the hull of a vessel, with the sea chest cover shown in partial cut-away to reveal the sea chest interior.
Figure 2:
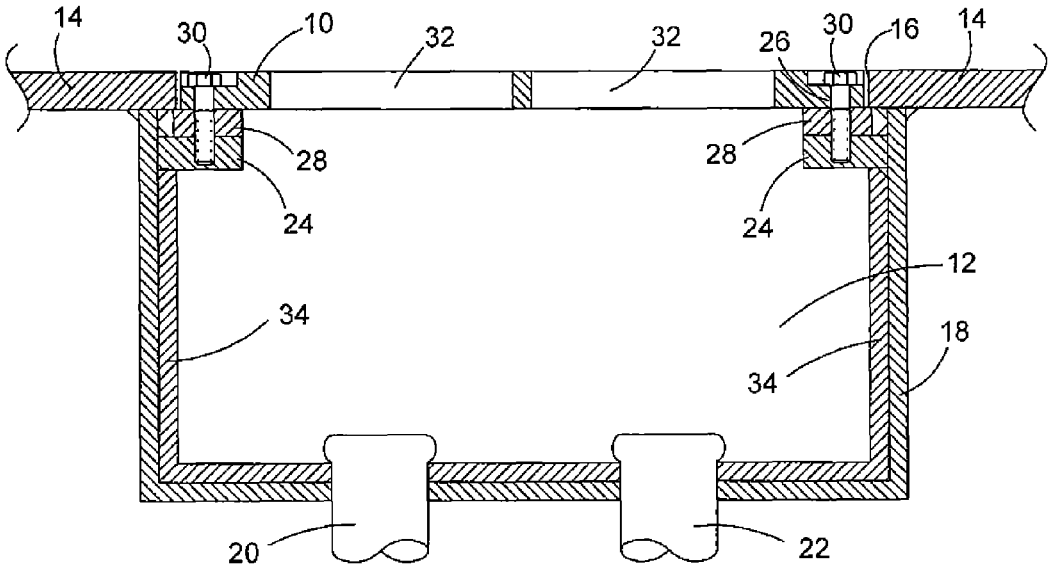
FIG. 2 is a cross-sectional view of the sea chest taken along line 2-2 of FIG. 1.

Referring to the drawings wherein identical reference numerals denote the same elements throughout the various views, FIGS. 1 and 2 depict one embodiment of a sea chest cover 10 covering a sea chest 12 that is formed in the hull 14 of a vessel. The sea chest 12 is defined by an opening 16 formed in the hull 14 and a casing 18 attached to the inside surface of the hull 14 about the opening 16. The sea chest 12 provides a reservoir through which water can be drawn in or discharged via inlet and outlet valves 20 and 22, respectively. The inlet and outlet valves 20 and 22, which are shown as being located in the bottom of the sea chest 12, could alternatively be located in the sidewalls of the sea chest 12.

The sea chest cover 10 is shaped and sized to fit relatively snugly within the hull opening 16. While the sea chest cover 10 is shown as being substantially rectangular in shape, it should be noted that the sea chest cover 10 and the sea chest 12 can have any of a variety of shapes, including circular or oval. The sea chest cover 10 can be flat, as depicted in FIG. 2, or the sea chest cover 10 can be shaped to conform to the contour of the hull 14 in the region of the vessel where the sea chest 12 is located. Such conformance may be achieved either by providing the sea chest cover 14 with the same contour as the hull during the fabrication process, or the sea chest cover 14 may be sufficiently flexible to be forced into conformance when mounted over the sea chest 12.

The sea chest cover 10 is mounted over the sea chest 12 in any suitable manner. In the illustrated embodiment, a number of mounting tabs 24 are fixedly attached to the sea chest casing 18 near the hull 14. The mounting tabs 24 are distributed around the perimeter of the opening 16 and extend inwardly so as to be situated just below the opening 16. The sea chest cover 10 includes a series of bolt holes 26 formed therein. The bolt holes 26 are located near the outer edge of the cover 10 and are distributed around the perimeter thereof so as to be aligned with corresponding threaded bolt holes 27 formed in the mounting tabs 24 when the cover 10 is placed in the opening 16. Spacers 28 can be provided between the cover 10 and the mounting tabs 24 to position the cover 10 flush with the outer surface of the hull 14. Bolts 30 extend through the bolt holes 26 and the spacers 28 and threadingly engage the mounting tabs 24 to removably secure the cover 10 to the sea chest 12. Because the sea chest casing 18, and hence the mounting tabs 24, are fixed relative to the hull 14, the sea chest cover 10 is secured in place relative to the hull 14 as well. Alternatively, upstanding bolts could be fixed to the mounting tabs 24 to extend through the bolt holes 26, and the cover 10 could then secured by nuts fastened to the bolts.

Figure 3:
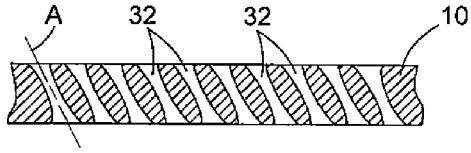
FIG. 3 is a cross-sectional view of the sea chest cover taken along line 3-3 of FIG. 1.

The sea chest cover 10 includes a plurality of apertures or slots 32 that extend between the upper and lower surfaces of the cover 10 so as to allow water to flow in and out of the sea chest 12. In the illustrated embodiment, the apertures 32 are in the form of elongated slots, but other embodiments of the present invention could have apertures of virtually any shape, including a series of perforations or holes. The slots 32 are sized to allow a desired flow rate therethrough, but prevent debris from entering the sea chest 12. As shown in FIG. 3, each slot 32 is hydrodynamically shaped to improve its flow characteristics. That is, the opposing sidewalls of each slot 32 define opposing convex surfaces so as to form a constriction at or near the midpoint of the slot 32. The constriction causes an increase in flow velocity of the water exiting the slot 32, thereby tending to reduce bio-fouling due to the growth of marine organisms in and around the slots 32. In addition, each slot 32 is configured to define a flow axis A that is slanted (i.e., arranged at an acute angle) relative to the outer surfaces of the cover 10, as seen in FIG. 3. This arrangement can prevent or reduce the occurrence of cavitations that would tend to be generated by the flow of water through the slots 32. Reducing cavitations slows deterioration of the cover 10 and decreases noise generation.

Referring again to FIG. 2, a liner 34 is provided for lining the interior of the sea chest 12. The liner 34 is adapted to be seated within the casing 18 so as to cover most or all of the sea chest interior. In the illustrated embodiment, the liner 34 covers the entire bottom wall of the casing 18 and extends up the sidewalls thereof to the mounting tabs 24. Alternatively, the liner 34 could be configured to fit around the mounting tabs 24. The liner 34 is preferably attached to the inner surfaces of the casing 18 with an adhesive. The adhesive not only secures the liner 34 to the casing 18, but also fills any gaps or voids occurring between the liner 34 and the casing 18. Any suitable adhesive could be used.

In another aspect of the invention, the sea chest cover 10 and the liner 34 are both made of a non-metallic material. Suitable non-metallic materials include, but are not limited to, viscoelastic polymers such as polyurethane, polyethylene (particularly high or extra-high molecular weight polyethylene), polypropylene, epoxies, and co-polymer combinations such as polyethylene-polypropylene. It is also possible to use reinforcing materials such as fibers and/or fabrics made of glass, carbon, metal, etc. to strengthen the non-metallic material. These non-metallic materials are much less dense and lighter than material commonly used in sea chests, such as steel and cast iron, but are generally strong enough to withstand the pressures and loads typically inflicted on the hull of a vessel. These materials also present a much smoother surface profile in comparison to the profile provided by metal components. The smooth surface profile restricts bio-fouling and ice build up, and in the event that such fouling or build up occasionally occurs, the smooth surface permits easy removal of those undesirable elements. It is also possible to mix additives, such as biocides, with the polymeric material to aid in further reducing bio-fouling of the sea chest cover 10 and the liner 34. The polymeric materials are generally more resistant to corrosion and erosion and, compared to cast iron and steel, the polymeric materials cushion vibration and reduce noise generated both from water moving through the cover 10 and from hull vibrations.

The sea chest cover 10 may be fabricated as a unitary piece using any suitable technique including, but not limited to, casting, injection molding, compression molding, or machining a sheet of stock material. The slots 32 can be machined, punched, or otherwise formed in the body of the sea chest cover 10 after it has been fabricated. The slots 32 can also be created during casting or molding of the sea chest cover 10. As an alternative to a single piece construction, the sea chest cover 10 may be constructed by assembling separately fabricated components. The liner 34 can also comprise either a single-piece or multi-piece construction. In some instances, the non-metallic material from which the sea chest cover 10 and the liner 34 are constructed can also be irradiated with gamma rays during the fabrication process for enhanced strength. Subjecting polymeric materials to gamma ray radiation during the fabrication process will cause the molecules of the materials to cross-link and readily adhere to each other, thereby enhancing material strength.

Figure 4:
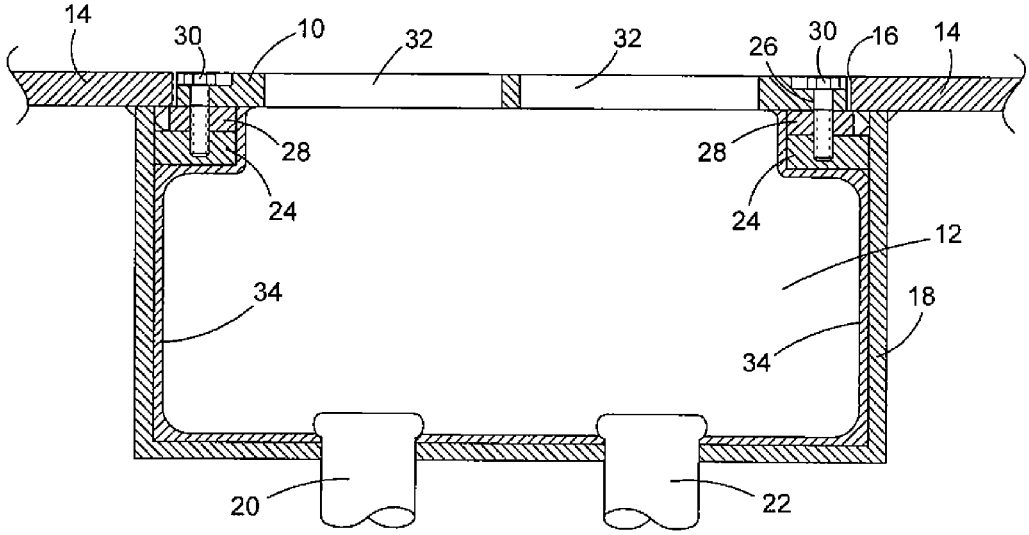
FIG. 4 is a cross-sectional view of another embodiment of a sea chest.

As an alternative to a separate structure that is mounted in the sea chest 12, the liner 34 can be a coating applied to the interior surfaces of the sea chest 12 as shown in FIG. 4. In this case, the coating can be applied using any suitable technique including, but not limited to, spraying, deposition, sputtering, etc. The liner 34 as a coating would comprise a non-metallic material as described above, and would thus have the same advantageous properties. Although FIG. 4 shows the liner 34 coating exposed surfaces only, it would be possible to apply the coating to all interior surfaces of the casing 18, as well as all surfaces of the mounting tabs 24 and the spacers 28. Liner material can also be applied to the exposed surfaces of the bolts 30 after the cover 10 is bolted in place.

Figure 5:
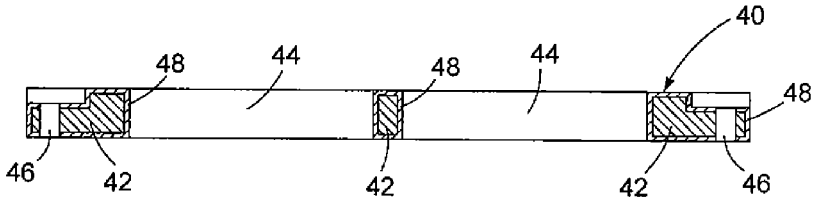
FIG. 5 is a cross-sectional view of another embodiment of a sea chest cover.
Figure 6:
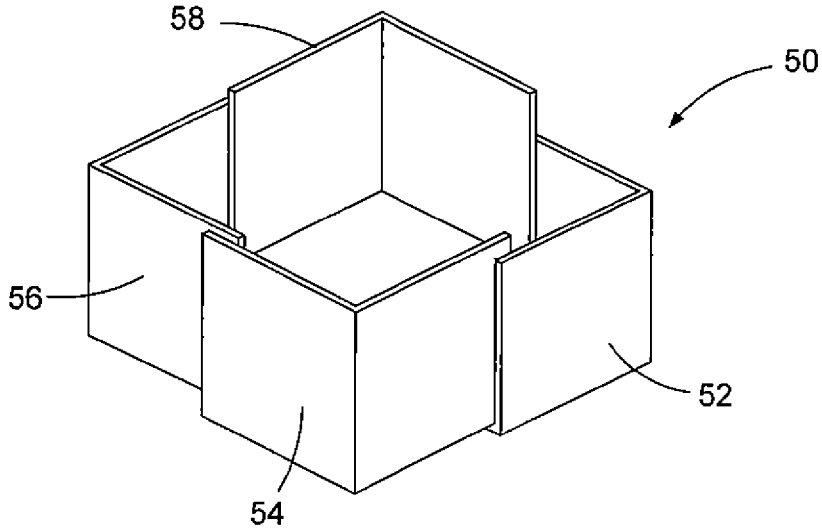
FIG. 6 is an isometric view of an alternate embodiment of a sea chest liner.
Figure 7:
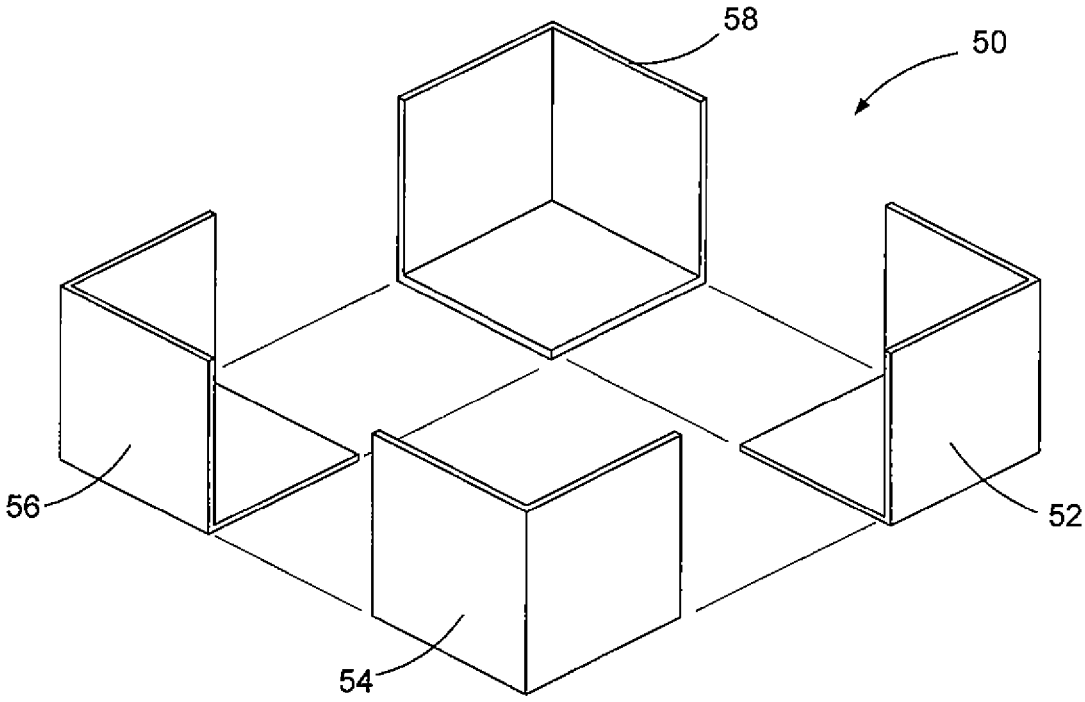
FIG. 7 is an exploded, isometric view of the sea chest liner of FIG. 6.

Turning to FIG. 5, a sea chest cover 40 in accordance with another possible embodiment is depicted. The sea chest cover 40 comprises a core piece 42 that is configured into the desired shape of the cover 40, including apertures 44 and bolt holes 46. The entire external surface of the core piece 42 is covered with a coating 48, leaving the apertures 44 and bolt holes 46 open. The core piece 42 is fabricated from any suitable material, including conventional materials such as steel or cast iron. The coating 48 is a non-metallic material such as any of the viscoelastic polymers described above. The coating 48 provides the cover 40 with many of the same benefits of the sea chest cover 10, including better resistance to bio-fouling, icing, corrosion and erosion, as well as reduced noise generation.

Figure 8:
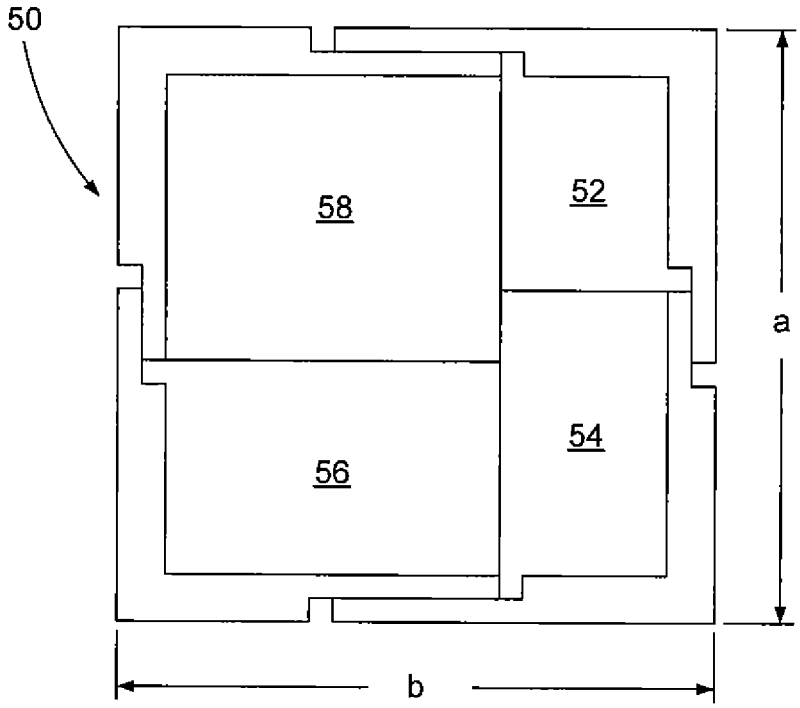
FIG. 8 is a first top view of the sea chest liner of FIG. 6.
Figure 9:
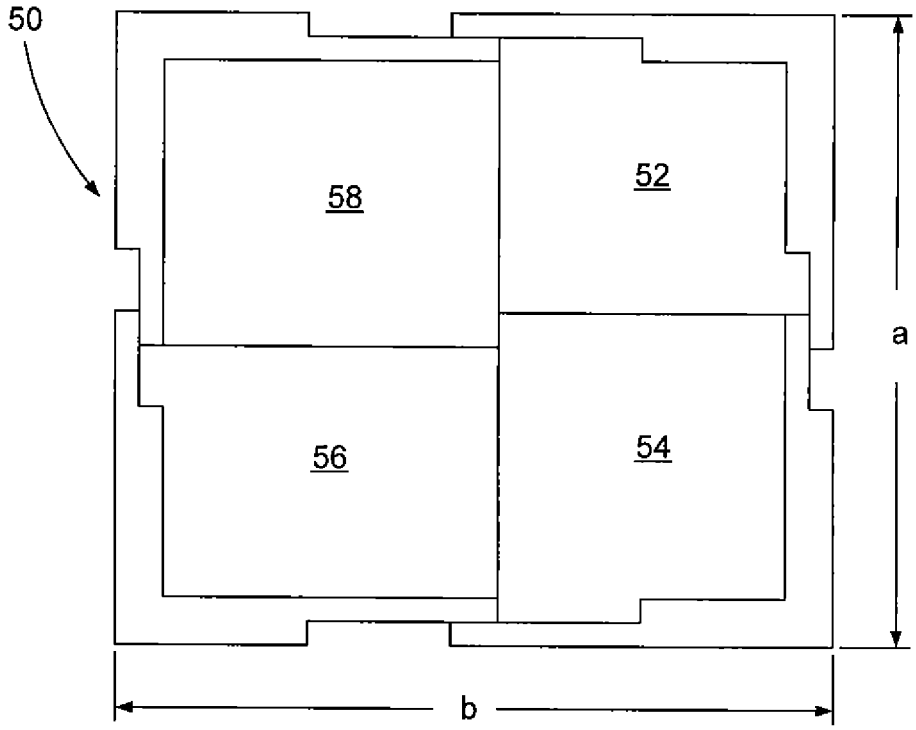
FIG. 9 is a second top view of the sea chest liner of FIG. 6.

FIGS. 6-9 show an alternative embodiment of a sea chest liner 50 that is designed to have adjustable lateral dimensions (dimensions "a" and "b" as shown in FIGS. 8 and 9). The sea chest liner 50 has four corner segments 52, 54, 56 and 58, where each corner segment includes a bottom wall and two sidewalls that are all mutually perpendicular. The corner segments 52-58 are arranged in a generally rectangular, box-like configuration wherein the sidewalls of each corner segment overlap a sidewall of each adjacent corner segment. The bottom walls of the corner segments 52-58 are arranged in a partially overlapping, stacked fashion with the bottom wall of the first corner segment 52 located on the bottom of the stack, the bottom wall of the second corner segment 54 being second, the bottom wall of the third corner segment 58 being third, and the bottom wall of the fourth corner segment 58 being on top of the stack. The sidewalls of the corner segments 52-58 are arranged so that a first sidewall of the first corner segment 52 is situated outside of a first sidewall of the fourth corner segment 58 and the second sidewall of the first corner segment 52 is situated outside of a first sidewall of the second corner segment 54. The second sidewall of the second corner segment 54 is situated outside of a first sidewall of the third corner segment 56, and the second sidewall of the third corner segment 56 is situated outside of the second sidewall of the fourth corner segment 58.

As shown in FIGS. 8 and 9, the overlapping portions of each corresponding pair of sidewalls are provided with matching notches that allow the two sidewalls to slide relative to one another. Each corner segment 52-58 is thus able to slide relative to the other corner segments 52-58 to adjust the lateral dimensions a and b of the sea chest liner 50. The dimension a of the liner 50 can be adjusted by sliding the second and third corner segments 54, 56 relative to the first and fourth corner segments 52, 58, and the dimension b of the liner 50 can be adjusted by sliding the first and second corner segments 52, 54 relative to the third and fourth corner segments 56, 58. FIG. 9 shows the lateral dimensions of the sea chest liner 50 expanded with respect to the dimensions depicted in FIG. 8.

This adjustability allows the sea chest liner 50 to be sized to fit sea chests of different sizes. For instance, the liner 50 could be placed inside of a sea chest and the corner segments 52-58 would be adjusted so their exterior surfaces would be in close contact with the interior walls of the sea chest casing. The liner 50 would be affixed to the sea chest casing with an appropriate adhesive or bonding material. The bonding material would also be applied to seal the interfaces or sliding joints between the corner segments 52-58.

While specific embodiments of the present invention have been described, it should be noted that various modifications thereto could be made without departing from the spirit and scope of the invention as defined in the appended claims.

What is claimed is:

1. In a sea chest defining a hull opening and an interior, the combination of:

a sea chest cover for covering said hull opening and having one or more apertures formed therein for allowing water to flow in and out of said sea chest interior, wherein said one or more apertures are configured and slanted relative to said sea chest cover to prevent or reduce cavitations; and a sea chest liner for lining said sea chest interior, wherein said sea chest cover and said sea chest liner are made of a non-metallic material, and wherein said sea chest liner is designed to have adjustable lateral dimensions.

2. The combination of claim 1 wherein said sea chest liner is mounted to said sea chest interior with an adhesive.

3. The combination of claim 1 wherein said sea chest liner is a coating applied to said sea chest interior.

4. The combination of claim 1 wherein said non-metallic material is a polymeric material.

5. The combination of claim 4 wherein said polymeric material includes a biocide additive.

6. The combination of claim 4 wherein said polymeric material is buoyant.

7. In a sea chest defining a hull opening and an interior, the combination of:

a sea chest cover for covering said hull opening and allowing water to flow in and out of said sea chest interior; and a sea chest liner for lining said sea chest interior, said sea chest liner being designed to have adjustable lateral dimensions, and wherein said sea chest cover and said sea chest liner are made of a non-metallic material.

8. The combination of claim 7 wherein said sea chest cover has one or more apertures formed therein for allowing water to flow in and out of said sea chest interior, said one or more apertures being configured to prevent or reduce cavitations.

9. The combination of claim 7 wherein said sea chest liner is mounted to said sea chest interior with an adhesive.

10. The combination of claim 7 wherein said non-metallic material is a polymeric material.

11. The combination of claim 10 wherein said polymeric material includes a biocide additive.

12. The combination of claim 10 wherein said polymeric material is buoyant.

* * * * *